US010962256B1

(12) United States Patent
Xu

(10) Patent No.: US 10,962,256 B1
(45) Date of Patent: Mar. 30, 2021

(54) NESTING MOLDED EQUIPMENT SUPPORT PADS

(71) Applicant: Rectorseal, LLC, Houston, TX (US)

(72) Inventor: Zhengyi Xu, Houston, TX (US)

(73) Assignee: Rectorseal, LLC, Houston, TX (US)

( * ) Notice: Subject to any disclaimer, the term of this patent is extended or adjusted under 35 U.S.C. 154(b) by 0 days.

(21) Appl. No.: 16/871,465

(22) Filed: May 11, 2020

Related U.S. Application Data

(60) Provisional application No. 62/960,866, filed on Jan. 14, 2020.

(51) Int. Cl.
*F24F 13/32* (2006.01)

(52) U.S. Cl.
CPC ..... *F24F 13/32* (2013.01)

(58) Field of Classification Search
CPC ..... F24F 13/32
See application file for complete search history.

(56) References Cited

U.S. PATENT DOCUMENTS 4,399,972 A 8/1983 McCulloch
4,869,456 A * 9/1989 Jacobs ..... F16M 5/00 248/678
5,664,394 A 9/1997 Sweeney
5,895,025 A 4/1999 Alesi et al.
5,961,093 A * 10/1999 Jones et al. ..... F24F 13/32 248/678
6,289,823 B1 * 9/2001 Koefelda et al. .. B65D 19/0018 108/53.3
9,016,653 B1 * 8/2015 Cox, Jr. et al. ..... B65D 19/002 248/346.01
2005/0040308 A1 2/2005 Sweeney et al.

* cited by examiner

*Primary Examiner* — Anita M King
(74) *Attorney, Agent, or Firm* — Marc L. Delflache; Jones Delflache LLP

(57) ABSTRACT

A nesting equipment support pad is disclosed, in particular an outdoor air conditioner compressor pad. The pad comprises a parallelogram upper surface which contacts the compressor and descending side walls from each edge of the parallelogram upper surface. Two side walls include a notch to accommodate a matching notch of another identical support pad when placed in a nesting arrangement. These notched corners are at diagonally opposing corners of each pad permitting the nesting arrangements. Additional, support rib members and protrusions are located within the cavity formed by the four side walls to provide strength and rigidity. These rib members and protrusions are placed in an offset manner to permit the nesting arrangement without interference with the mating pad.

20 Claims, 4 Drawing Sheets

NESTING MOLDED EQUIPMENT SUPPORT PADS

This application is based on priority U.S. provisional application 62/960,866, filed Jan. 14, 2020 and entitled Nesting Equipment Molding Pads, which application is hereby incorporated by reference in its entirety and made a part of this Application.

FIELD OF THE INVENTION

The present invention relates generally to molded equipment pads that are capable of nesting together to allow for lower shipping costs.

BACKGROUND OF THE INVENTION

Support pads can be used in a variety of different end uses such as HVAC condensers, heat pumps and so forth. As such equipment is often placed outdoors, it is desirable to keep the equipment off the ground using a support pad. Due to the weight of some of the equipment, such as HVAC condensers, prior art support pads have included solid pads made of a single material, such as concrete, or a shell material having a less dense inner core, such as a cementitious shell and a foam core. The solid pads are heavy while the shell-based pads have the advantage of being lighter. Some equipment pads are made of molded plastic, however, because of the weight of the equipment these plastic molded pads require internal ribs in the hollow area of the pad underneath the top surface. A downside of both the solid pads and the plastic molded pads with internal ribs is that these products are expensive to ship because they are not nestable. That is, they are not stackable. What is needed is an equipment support pad that is both strong enough to hold relatively heavy equipment and is also nestable so that it is less expensive to ship.

SUMMARY OF THE INVENTION

Accordingly, the present disclosure relates to nestable molded equipment support pads designed to save on transportation costs. Each equipment support pad comprises an upper surface having a generally parallelogram shape with preferable four side walls of a generally equal height extending downward from the upper surface and attached at the four corners of the pad below the upper surface. There is a first notch in a first side wall that is preferably from at least about one-half the height of the first side wall to the full height of the first side wall and a second notch in a second side wall that is preferably at least about one-half the height of the second side wall to the full height of the second side wall. The second side wall is adjacent to the first side wall and the two notches are at opposite ends of the adjacent side walls. This placement of the notches in the side walls assures that the two notches are near opposing diagonal corners of the side walls.

The equipment pad described immediately above is nestable with an identical second molded plastic equipment pad. This is achieved by aligning the two notches in the first equipment pad with the two corresponding notches in a second equipment pad inserting the notches into one another so that the two equipment pads nest together, with the two equipment pads slightly offset from one another and with their upper surfaces on opposite sides of the nested assembly.

Additional combinations of two nested pads can then be stacked on top of one another and placed on a pallet for shipping.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed. Though the following disclosure describes a pad for an air conditioning system, it should be understood that the present invention could be used with other molded equipment support pads.

BRIEF DESCRIPTION OF THE DRAWINGS

The following figures are part of the present specification, included to demonstrate certain aspects of various embodiments of this disclosure and referenced in the detailed description herein. In order that the present disclosure may be more fully comprehended, the disclosure will be described, by way of example, with reference to the accompanying figures, wherein like reference characters indicate like parts throughout the several figures. The figures are not necessarily to scale, and certain features and certain views of the figures may be shown exaggerated in scale or in schematic in the interest of clarity and conciseness.

DETAILED DESCRIPTION OF THE PREFERRED EMBODIMENTS

Figure 1:
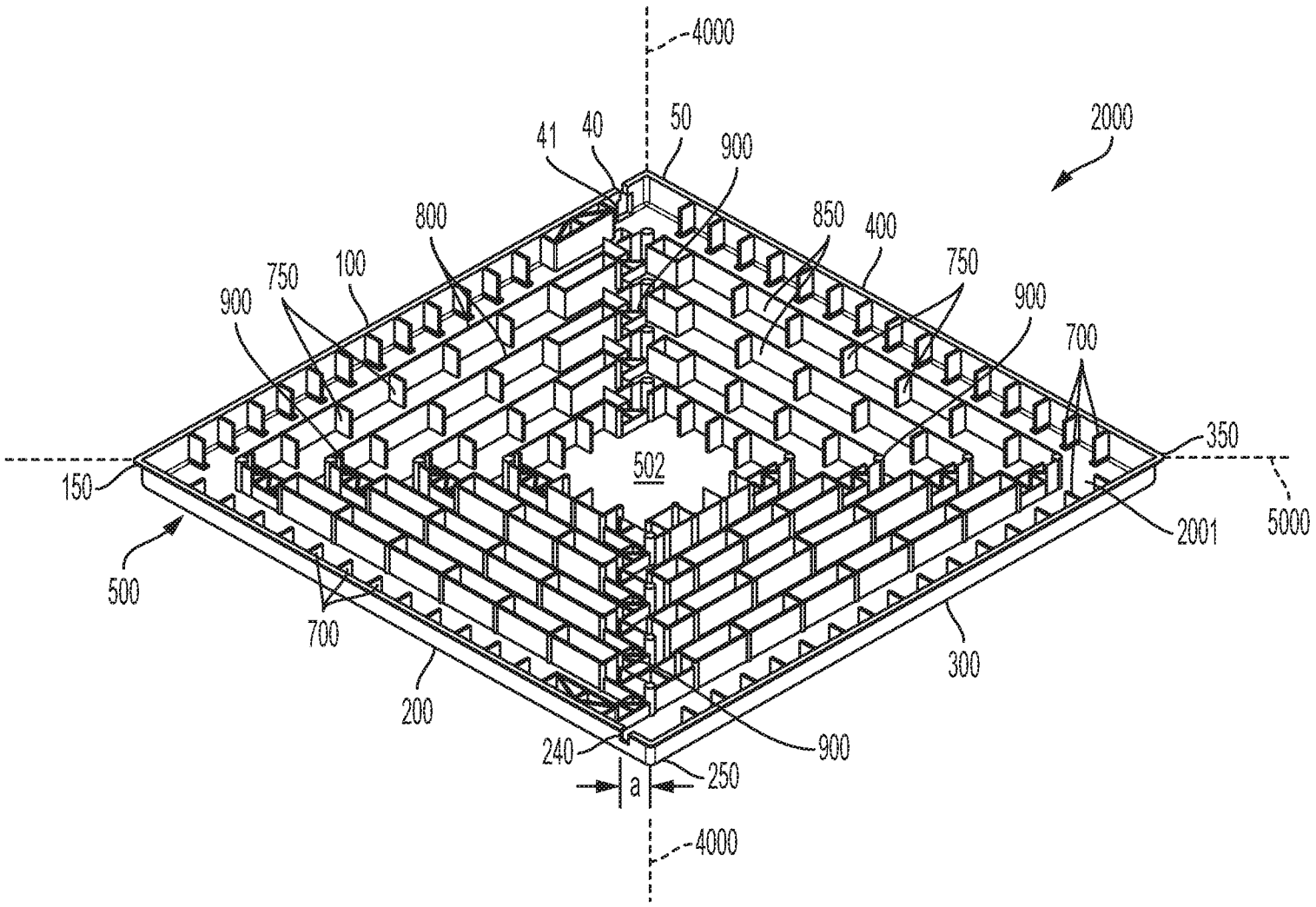
FIG. 1 is an isometric view of one support pad of the present invention illustrating the underside of the upper surface and having notches on two side walls at diagonally opposite corners of the support pad.

The following description provides specific details, such as material types, compositions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of exemplary embodiments, is not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

As used herein and throughout various portions (and headings) of this patent application, the terms "disclosure", "present disclosure" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

As used herein and throughout various portions (and headings) of this patent application, the terms "disclosure", "present disclosure" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function.

Also, the terms "including" and "having" and "comprising" are used herein and in the appended claims in an open-ended fashion, and thus should be interpreted to mean "including, but not limited to . . . ."

Further, reference herein and in the appended claims to components and aspects in a singular tense does not necessarily limit the present disclosure or appended claims to only one such component or aspect, but should be interpreted generally to mean one, as may be suitable and desirable in each particular instance.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

All ranges disclosed herein are inclusive of the endpoints. A numerical range having a lower endpoint and an upper endpoint shall further encompass any number and any range falling within the lower endpoint and the upper endpoint. For example, every range of values (in the form "from a to b" or "from about a to about b" or "from about a to b," "from approximately a to b," "between about a and about b," and any similar expressions, where "a" and "b" represent numerical values of degree or measurement is to be understood to set forth every number and range encompassed within the broader range of values and inclusive of the endpoints.

The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

All references are incorporated herein by reference.

Preferred embodiments of the present disclosure thus offer advantages over the prior art and are well adapted to carry out one or more of the objects of this disclosure. However, the present disclosure does not require each of the components and acts described above and is in no way limited to the above-described embodiments or methods of operation. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims.

FIGS. 1-4 illustrate the nesting moldable equipment support pad of the present invention.

Figure 2:
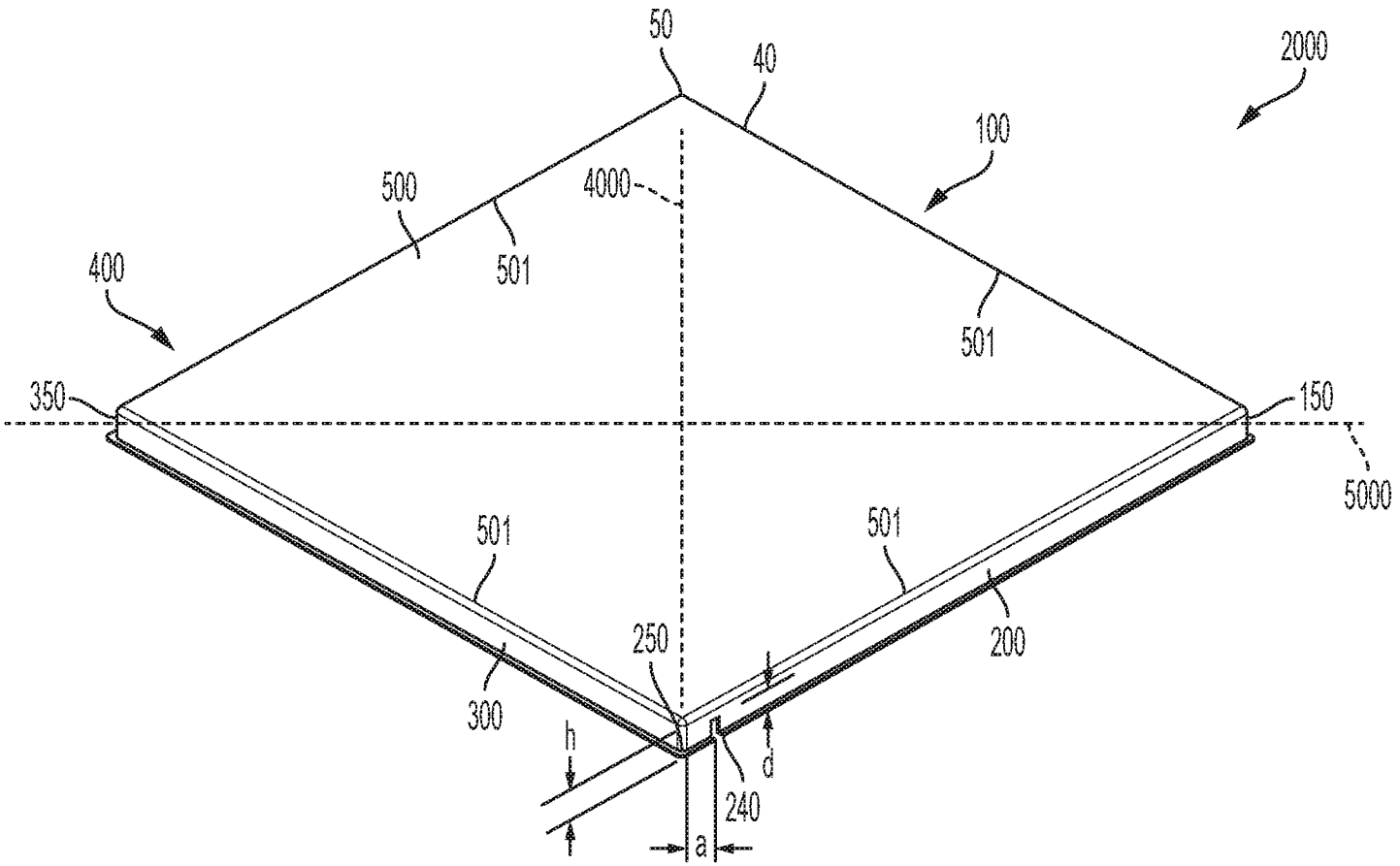
FIG. 2 is an isometric view of the support pad from FIG. 1 wherein the support pad has been flipped over so that the upper surface of the pad is visible as it would sit on the ground surface and showing one notch in one side wall.

Referring first to FIG. 2, pad 2000 comprises an upper surface 500 on which a piece of equipment, such as an HVAC condenser, may rest. Upper surface 500 is preferably shaped as a parallelogram (e.g square or rectilinear) and has four side walls 100/200/300/444 extending downwardly from the perimeter edge 501 of upper surface 500 with the side walls meeting at corners 50, 150, 250 and 350. Obviously, upper surface may have a shape other than a parallelogram provided the side walls are notched as generally described herein and such an alternate shaped pad may nest in the manner described herein. Referring still to FIG. 2, sidewall 200 includes a notch 240 adjacent to corner 250. Side wall 100 includes a notch 40 adjacent to corner 50 (see FIG. 1).

Referring now to FIG. 1, the bottom surface 2001 or bottom interior of pad 2000 is illustrated. Side walls 100/200/300/400 and bottom surface 2001 form cavity 502. Cavity 502 has a series of elements, such as protrusions 700/750, ribs 800/850 (discussed further below), extending into cavity 502.

Comparing FIG. 1 to FIG. 2, pad 2000 is inverted along axis 4000 extending from corner 250 to corner 50. Thus, FIG. 1 is the underneath of pad 2000 as shown is FIG. 2. In FIG. 1, notch 240 and notch 40 face upwardly as shown. Referring still to FIG. 2, notches 40 (as seen in FIG. 1) and 240 (as seen in FIG. 2) have a depth "d" that is approximately one-half the height "h" of side walls 100 and 200. In some embodiments notches 40 and 240 can be more than about half the height of the side walls up to and including the full height "h" of side walls 100 and 200. In order for pad 2000 to rest flat on the ground, side walls 100 and 200 have heights "h" approximately equal to side walls 300 and 400. Notch 40 may have a strengthening bracket 41 (FIG. 1). Similarly, notch 240 may have a strengthening bracket (not visible in FIG. 1). In like manner, notches 40/240, surface 500, and side walls 100/200/300/400 may include strengthening brackets as integral parts of pad 2000 and may be molded in place as a single integral piece.

Referring more particularly to FIG. 1, protrusions 700 extend inwardly from side walls 100/200/300/400 into cavity 502. In at least some embodiments protrusions 700 are the same height "h" of the corresponding side walls. Protrusions 700 act to strengthen side walls 100/200/300/400 and bottom 2001 of top surface 500 of pad 2000. In addition to protrusions 700, there are series of interior ribs 800 included in interior cavity 502. Interior ribs 800 act to strengthen pad 2000 so that equipment can be placed on upper surface 500 without deforming the shape of pad 2000. Interior ribs 800 and side wall protrusions 700 allow pad 2000 to be molded with less plastic material, or other material if preferable, since protrusions 700 and ribs 800 provide strength and rigidity. The result is a less heavy product and a less expensive product to manufacture and ship.

Figure 4:
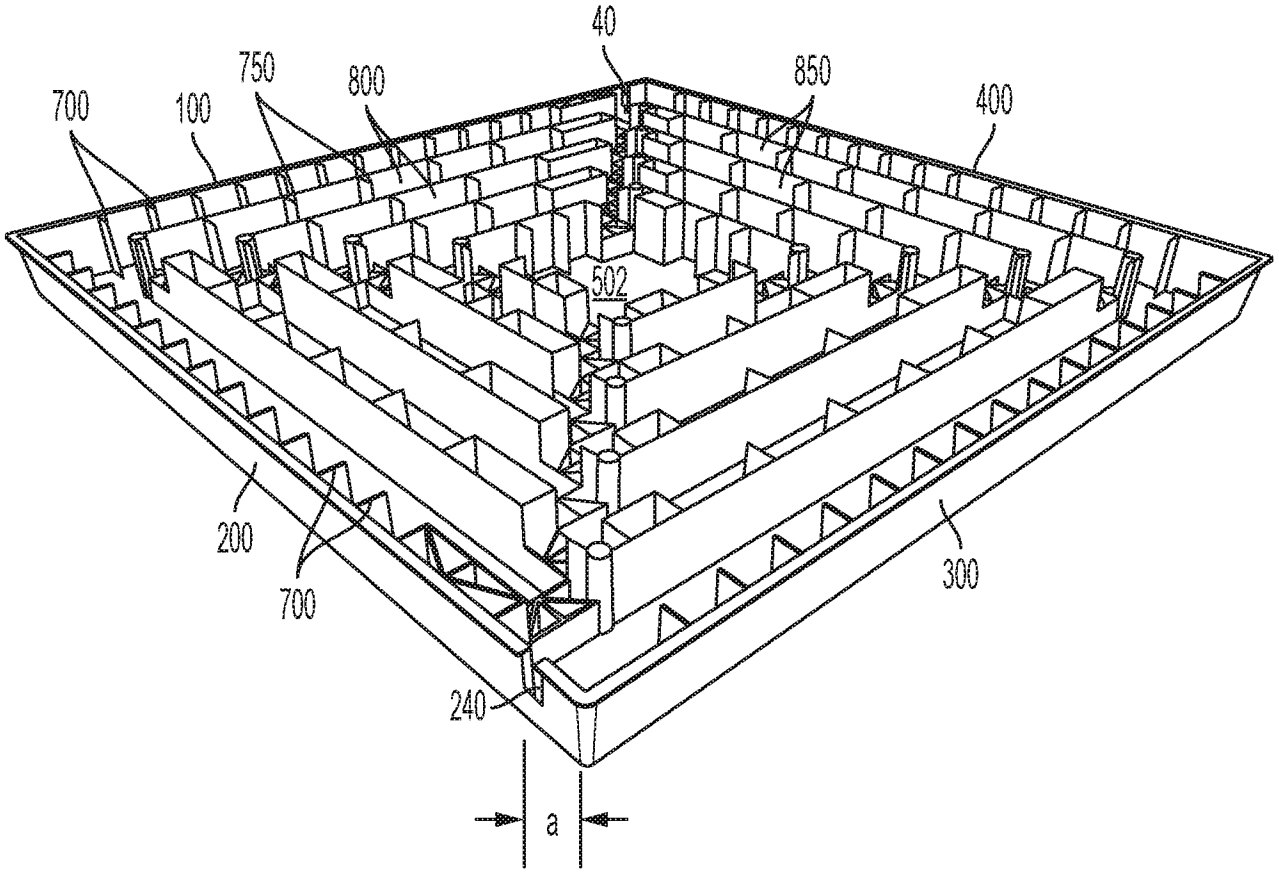
FIG. 4 is an isometric view underside of the pad as shown in FIG. 2.

FIGS. 1 and 4 show that interior ribs 800 are essentially interior side walls that run continuously around different interior perimeter sizes within interior cavity 502. Ribs 800 also meet other interior ribs 850 at an angle of about 90 degrees. Interior ribs 800/850 in some embodiments may also include protrusions 750 similar to protrusions 700 on the side walls to help strengthen ribs 800/850. Ribs 800/850 extend downward from upper surface 500 into cavity 502 and in at least some embodiments are the same height as side walls 100/200/300/400 through most of their length. Ribs 800/850 are shown as being rectilinear in shape, but they could be other shapes as well. In at least one embodiment (not shown) ribs 800/500 are simply protrusions or columns extending downward from upper surface 500 into interior cavity 502. In this manner ribs 800/850 serve to significantly strengthen pad 2000 and improve its rigidity substantially.

Figure 3:
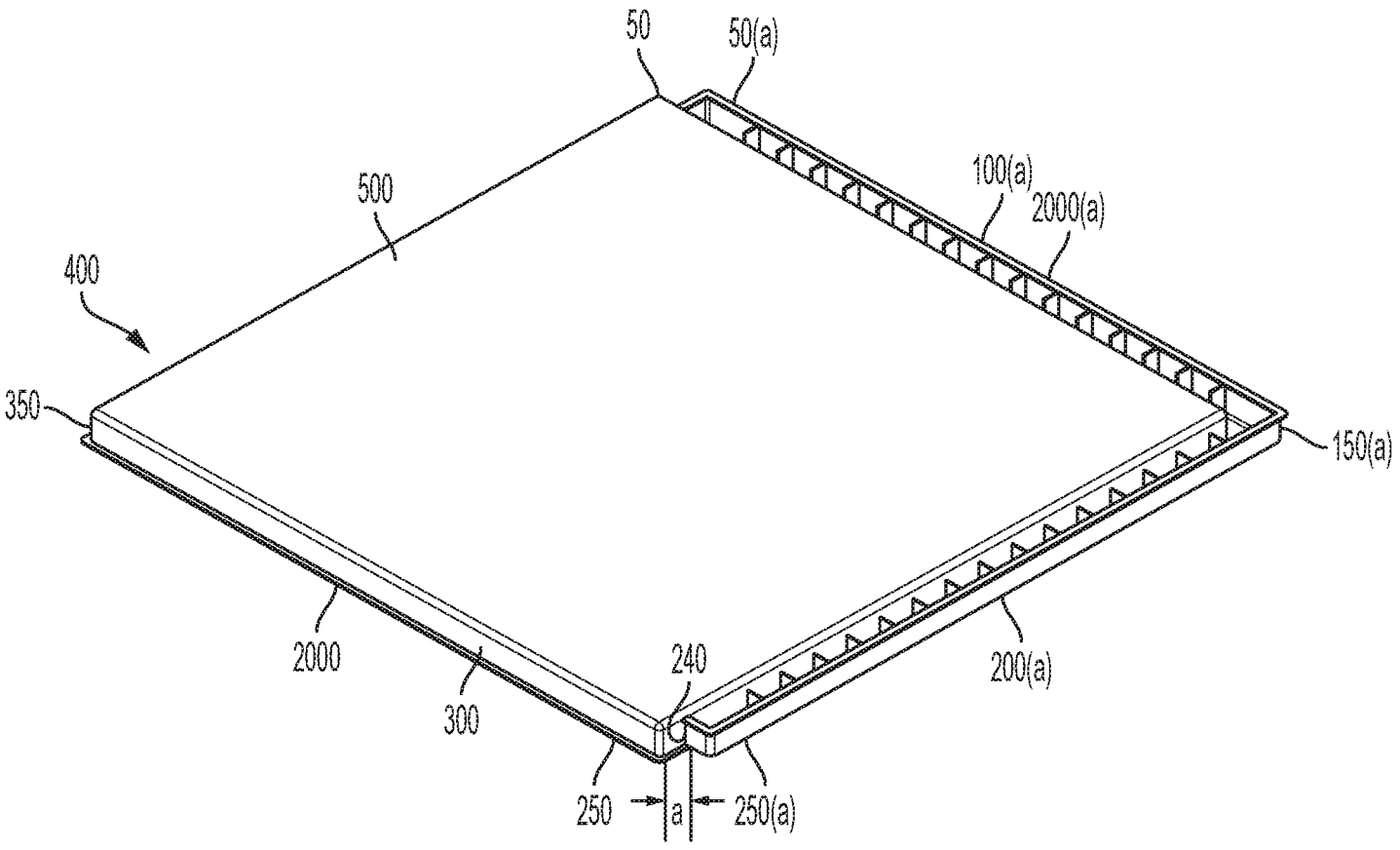
FIG. 3 shows an isometric view of the two support pads as shown in FIGS. 1 and 2 wherein the two pads of the present invention are nested together.

Referring now to FIG. 3, pad 2000 from FIG. 2 and a second identical pad 2000(*a*) are shown in a nested arrangement. As shown in FIG. 3, pad 2000 from FIG. 2 is placed onto identical pad 2000(*a*) and held in place by aligning notches 240/240(*a*) and notches 40/40(*a*) (not visible in FIG. 3) so that pad 2000 is offset from the identical pad 2000(*a*) by a distance "a" equal to the distance between corner 250 and notch 240 and corner 50 and notch 40 (notch 40 is shown in FIG. 1). Because notches 40/240 are approximately one-half the height "h" of the side walls this allows nesting of two identical pads so that their combined height when the notches nest together is approximately the height "h" of one pad. The footprint of the combination of the two identical pads (2000 and 2000(*a*)) is increased by distance "a" in both width and length but the approximate halving of the combined height makes this a relatively small increase in the footprint of pads 2000/2000(*a*). Furthermore, the nested two-pad combination shown in FIG. 3 can be stacked with other two pad combinations (i.e. top surfaces 500 stacked on top of one another) so that roughly twice as many pads can be put on the same sized pallet as before, significantly reducing shipping costs.

The distance "a" diagonal offset as shown in FIG. 3 requires that ribs 800 and protrusions 700 not interfere with one another when the interiors of the pads are nested together in the offset position. This requires that protrusions 700 on the side walls be less than distance "a" in length. It also requires that ribs 800 when combined with their corresponding protrusions 850 also be less than distance "a" in width. In at least one embodiment, ribs 800 have a continuous perimeter in cavity 502 as shown in FIGS. 1 and 4 to maximize the effectiveness of ribs 800. When there is a continuous perimeter for interior ribs 800 it requires that ribs 800 have portions of their length that need to be half or less than half the height of the side walls not to interfere with nesting. The portions of ribs 800 that are half or less than half the height of the side walls is offset from the corners of the ribs by the same distance "a". As seen in FIGS. 1 and 4, in a series of ever smaller perimeter interior ribs 850 in a generally parallelogram (preferably, rectangular) configuration the lower height portions of ribs 850 have an "X" appearance (900) that runs diagonally generally along axes 4000 and 5000 from the corners of pad 2000.

The pads described herein can be a variety of shapes and sizes. By means of example, in a square pad with a width of 36 inches and a length of 36 inches, the height of the sides walls is approximately 2-3 inches, and the depth of the notches are approximately 1 to 1.5 inches and the width of the notches is approximately 0.5 inches. The thickness of the upper surface 500 is approximately 0.1 inches; the thickness of protrusions 700 is approximately 0.08 inches and the length of protrusions 700 is approximately 1 inch; the thickness of ribs 800/850 is 0.08 inches. Although a variety of materials can be used, pads molded from polypropylene plastics have been effective. Other possible plastics include polyethylene, PVC and polycarbonate.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An equipment pad comprising: a first equipment pad comprising:

an upper surface having four corners in a parallelogram configuration and an outer edge for each side of the upper surface;

a plurality of side walls descending downwardly from the upper surface, each side wall having a top edge and a bottom edge and each side wall attached at its top edge to one outer edge of the upper surface, each side wall being approximately the same height, wherein the side walls being configured to attached to another side wall at each of its ends at the four corners of the upper surface;

a first side wall having a notch proximate one end the first side wall, said notch being approximately at least one-half the height of the first side wall; and a second side wall having a notch proximate one end the second side wall, said notch being approximately at least one-half the height of the second side wall, wherein the second side wall being adjacent to the first side wall and wherein the two notches are at opposite ends of the adjacent first and second side walls thereby placing the two notches at proximately opposing diagonal corners of the upper surface.

2. The equipment pad according to claim 1 wherein the first equipment pad is manufactured as a molded integral unit.

3. The equipment pad according to claim 2 wherein the first equipment pad is molded of plastic.

4. The equipment pad according to claim 1 wherein the upper surface has a rectangular configuration.

5. The equipment pad according to claim 1 wherein the upper surface has a square configuration.

6. The equipment pad according to claim 1 further comprising:

the plurality of side walls descending downwardly from the upper surface define a cavity below the upper surface;

rib members supported within said cavity providing strength and rigidity to the first equipment pad.

7. The equipment pad according to claim 1 further comprising:

a second equipment pad comprising:

an upper surface having four corners in a parallelogram configuration and an outer edge for each side of the upper surface;

a plurality of side walls descending downwardly from the upper surface, each side wall having a top edge and a bottom edge and each side wall attached at its top edge to one outer edge of the upper surface, each side wall being approximately the same height, wherein the side walls being configured to attached to another side wall at each of its ends at the four corners of the upper surface;

the first side wall having a notch proximate one end the first side wall, said notch being approximately one-half the height of the first side wall; and the second side wall having a notch proximate one end the second side wall, said notch being approximately one-half the height of the second side wall, wherein the second side wall being adjacent to the first side wall and wherein the two notches are at opposite ends of the adjacent first and second side walls thereby placing the two notches at proximately opposing diagonal corners of the upper surface, wherein, the notches of the first and second side walls of the first equipment pad being configured to engage the notches of the first and second side walls of the second equipment pad enabling the first and second equipment pads to nest together with the upper surface of the first equipment pad and the upper surface of the second equipment pads being on opposite sides of the nested configuration.

8. The equipment pad according to claim 6 wherein the second equipment pad is manufactured as a molded integral unit.

9. The equipment pad according to claim 6 wherein the second equipment pad is molded of plastic.

10. The equipment pad according to claim 6 wherein the upper surface of the second equipment pad has a rectangular configuration.

11. The equipment pad according to claim 6 wherein the upper surface of the second equipment pad has a square configuration.

12. The equipment pad according to claim 6 further comprising:

the plurality of side walls descending downwardly from the upper surface of the first equipment pad define a cavity below the upper surface of the first equipment pad;

rib members supported within said cavity of the first equipment pad providing strength and rigidity to the first equipment pad, wherein the rib members within the cavity of the first equipment pad;

the plurality of side walls descending downwardly from the upper surface of the second equipment pad define a cavity below the upper surface of the second equipment pad;

rib members supported within said cavity of the second equipment pad providing strength and rigidity to the second equipment pad wherein the rib members within the cavity of the second equipment members, so that upon nesting of the first and second equipment pads the rib members of the first and second equipment pads also nest enabling the notches of the first equipment pad and the notches of the second equipment pads to engage permitting the upper surface of the first equipment pad and the upper surface of the second equipment pads to rest on opposite sides of the nested configuration.

13. A nesting equipment pad configuration comprising:

a first equipment pad comprising:

an upper surface having four corners in a parallelogram configuration and an outer edge for each side of the upper surface, a plurality of side walls descending downwardly from the upper surface, each side wall having a top edge and a bottom edge and each side wall attached at its top edge to one outer edge of the upper surface, each side wall being approximately the same height, wherein the side walls being configured to attached to another side wall at each of its ends at the four corners of the upper surface, the first side wall having a notch proximate one end the first side wall, said notch being approximately at least one-half the height of the first side wall, and the second side wall having a notch proximate one end the second side wall, said notch being approximately at least one-half the height of the second side wall, wherein the second side wall being adjacent to the first side wall and wherein the two notches are at opposite ends of the adjacent first and second side walls placing the two notches at opposing diagonal corners of the upper surface, an upper surface; and a second equipment pad comprising:

an upper surface having four corners in a parallelogram configuration and an outer edge for each side of the upper surface of the second equipment pad, a plurality of side walls descending downwardly from the upper surface, each side wall having a top edge and a bottom edge and each side wall attached at its top edge to one outer edge of the upper surface, each side wall being approximately the same height, wherein the side walls being configured to attached to another side wall at each of its ends at the four corners of the upper surface, the first side wall of the second equipment pad having a notch proximate one end the first side wall of the second equipment pad, said notch being approximately at least one-half the height of the first side wall, and the second side wall of the second equipment pad having a notch proximate one end the second side wall of the second equipment pad, said notch being approximately at least one-half the height of the second side wall of the second equipment pad, wherein the second side wall of the second equipment pad being adjacent to the first side wall of the second equipment pad and wherein the two notches are at opposite ends of the adjacent first and second side walls of the second equipment pad thereby placing the two notches at opposing diagonal corners of the upper surface of the second equipment pad, wherein the notches of the first and second side walls of the first equipment pad being configured to engage the notches of the first and second side walls of the second equipment pad enabling the first and second equipment pads to nest together with the upper surface of the first equipment pad and the upper surface of the second equipment pads being on opposite sides of the nested configuration.

14. The nesting equipment pad configuration of claim 13 wherein the first and second equipment pads are each manufactured separately as a molded integral unit.

15. The nesting equipment pad configuration of claim 14 wherein the first and second equipment pads are molded of plastic.

16. The nesting equipment pad configuration of claim 13 wherein the upper surfaces of the first and second equipment pads have a rectangular configuration.

17. The nesting equipment pad configuration of claim 13 wherein the upper surfaces of the first and second equipment pads have a square configuration.

18. A nesting equipment pad configuration comprising:

a first equipment pad comprising:

an upper surface having four corners in a parallelogram configuration and an outer edge for each side of the upper surface, a plurality of side walls descending downwardly from the upper surface, each side wall having a top edge and a bottom edge and each side wall attached at its top edge to one outer edge of the upper surface, each side wall being approximately the same height, wherein the side walls being configured to attached to another side wall at each of its ends at the four corners of the upper surface defining a cavity below the upper surface of the first equipment pad, rib members attached to upper surface and supported within said cavity of the first equipment pad providing strength and rigidity to the first equipment pad, the first side wall having a notch proximate one end the first side wall, said notch being approximately at least one-half the height of the first side wall;

the second side wall having a notch proximate one end the second side wall, said notch being approximately at least one-half the height of the second side wall, wherein the second side wall being adjacent to the first side wall and wherein the two notches are at opposite ends of the adjacent first and second side walls thereby placing the two notches at opposing diagonal corners of the upper surface; and a second equipment pad comprising:

an upper surface having four corners in a parallelogram configuration and an outer edge for each side of the upper surface of the second equipment pad, a plurality of side walls descending downwardly from the upper surface of the second equipment pad, each side wall having a top edge and a bottom edge and each side wall attached at its top edge to one outer edge of the upper surface of the second equipment pad, each side wall of the second equipment pad being approximately the same height, wherein the side walls being configured to attached to another side wall at each of its ends at the four corners of the upper surface defining a cavity below the upper surface of the second equipment pad, rib members attached to the upper surface of the second equipment pad and supported within said cavity of the second equipment pad providing strength and rigidity to the first equipment pad, the first side wall of the second equipment pad having a notch proximate one end the first side wall, said notch being approximately at least one-half the height of the first side wall of the second equipment pad, and the second side wall of the second equipment pad having a notch proximate one end the second side wall, said notch being approximately at least one-half the height of the second side wall of the second equipment pad, wherein the second side wall of the second equipment pad being adjacent to the first side wall of the second equipment pad and wherein the two notches are at opposite ends of the adjacent first and second side walls second equipment pad thereby placing the two notches at opposing diagonal corners of the upper surface of the second equipment pad, wherein, the notches of the first and second side walls of the first equipment pad being configured to engage the notches of the first and second side walls of the second equipment pad enabling the first and second equipment pads to nest together with the upper surface of the first equipment pad and the upper surface of the second equipment pads being on opposite sides of the nested configuration.

19. The nesting equipment pad configuration according to claim 18 wherein the first and second equipment pads are each separately manufactured as a molded integral unit.

20. The nesting equipment pad configuration according to claim 19 wherein the first and second equipment pads are each separately manufactured of plastic.

* * * * *